US007503562B2

(12) United States Patent
Haberstroh

(10) Patent No.: US 7,503,562 B2
(45) Date of Patent: Mar. 17, 2009

(54) APPARATUS FOR PROCESSING SHEET MATERIAL

(75) Inventor: Markus Haberstroh, Landsberg (DE)

(73) Assignee: Giesecke & Devrient GmbH, Munich (DE)

( * ) Notice: Subject to any disclaimer, the term of this patent is extended or adjusted under 35 U.S.C. 154(b) by 89 days.

(21) Appl. No.: 10/570,664

(22) PCT Filed: Sep. 6, 2004

(86) PCT No.: PCT/EP2004/009927

§ 371 (c)(1),
(2), (4) Date: Sep. 22, 2006

(87) PCT Pub. No.: WO2005/026028

PCT Pub. Date: Mar. 24, 2005

(65) Prior Publication Data

US 2007/0063431 A1 Mar. 22, 2007

(30) Foreign Application Priority Data

Sep. 9, 2003 (DE) ..... 103 41 589

(51) Int. Cl.
*B65H 5/02* (2006.01)

(52) U.S. Cl. ..... 271/275

(58) Field of Classification Search ..... 271/272, 271/275, 188, 198; 198/606, 817
See application file for complete search history.

(56) References Cited

U.S. PATENT DOCUMENTS

| | | | | |
|---|---|---|---|---|
| 3,545,371 | A * | 12/1970 | Reist | 100/176 |
| 4,106,767 | A * | 8/1978 | Schirrmeister et al. | 271/188 |
| 4,373,712 | A * | 2/1983 | Mitzel | 271/272 |
| 5,797,599 | A * | 8/1998 | Meyer et al. | 271/272 |
| 7,316,477 | B2 * | 1/2008 | Yoda | 347/104 |

FOREIGN PATENT DOCUMENTS

| | | |
|---|---|---|
| DE | 29 55 580 | 6/1977 |
| DE | 29 23 148 | 12/1980 |
| DE | 31 22 490 C2 | 4/1982 |
| DE | 42 43 626 C2 | 9/1993 |
| DE | 196 36 172 A1 | 3/1998 |
| DE | 198 40 420 A1 | 3/2000 |
| DE | 102 07 073 A1 | 9/2003 |
| WO | WO 01/25127 A1 | 4/2001 |

* cited by examiner

*Primary Examiner*—Kaitlin S Joerger
(74) *Attorney, Agent, or Firm*—Bacon & Thomas, PLLC

(57) ABSTRACT

In a bank note processing machine bank notes 100 are led through between two components of a checking device with the help of a conveyor belt. The conveyor belt is led away from the transport path and around the checking device with the help of deflection rollers. Coaxially to the deflection rollers are disposed clamping rings or clamping rollers, which grasp the sheet material and guide it through the checking device. This operation is supported by a guide plate, which combs with the clamping rings.

11 Claims, 3 Drawing Sheets

APPARATUS FOR PROCESSING SHEET MATERIAL

BACKGROUND

A. Field

The invention relates to an apparatus for processing sheet material, in particular a bank note processing machine, wherein the sheet material is held between a conveyor belt and further transport devices disposed opposite the conveyor belt and guided through between at least two components of a checking device disposed opposite each other.

B. Related Technology

The conveyor belt serves for guiding and for pressing the sheet material against the transport devices disposed opposite and against guiding paths or checking devices disposed in between. The transport devices usually are transport rolls or transport rollers or a second conveyor belt, which with the help of deflection rollers is either led back directly before and behind the checking device or is led around the checking device.

As to maintain a reliable transport function even with fluctuating sheet thickness, in DE 198 40 420 A1 is proposed that the run of the first conveyer belt facing the material is loaded elastically in the direction of the sheet material by pressure elements. In DE 29 23 148 A1 it is furthermore proposed to guide the second conveyor belt on deflection rollers in grooves, so that the speed of the sheet material is determined by the first conveyor belt located external in deflection direction. The internal, second conveyor belt merely serves for supporting the sheet material between adjacent deflection rollers, whereas such support instead can also be obtained by a transparent glass plate replacing the second conveyor belt, when the sheet material is to be accessible over its entire width for checking purposes.

The first conveyor belt assuming guiding and pressing function in the area of the checking device, however, impedes the carrying out of a transmission measuring at the sheet material. A soiling measurement is also impeded, since for such a measurement the sheet material usually has to be illuminated from two sides. Therefore, the first conveyor belt usually is replaced by a plurality of narrow belts extending in parallel side-by-side in transport direction and spaced apart from each other. But, however, also with this a full areal measurement of the sheet material over its entire width is not possible. The positions of the belts are rather perceived as dark longitudinal stripes when evaluating e.g. transmitted light.

As to ensure free accessibility for checking purposes, therefore, the transport path must be interrupted and the sheet material measured in free flight by the checking device. Such a measurement during free flight, however, is problematic in the case of low transport speeds and in particular in the case of limp sheet material. Here gravity can incalculably influence the sheet material and lead to the blocking of the machine. DE-A 26 55 580 describes such a free-flight path, the bank notes being conveyed clamped between a plurality of belt pairs. Before and behind the checking device the belts are led away from the transport path via deflection rollers, so that the sheet material passes the checking device in free flight. Here the belt pairs located opposite each other are disposed to each other so as to fill gaps and slightly mesh with each other. Thereby onto the transported bank notes is impressed a reversible wave profile perpendicular to the transport direction which leads to an increase of the stiffness of the sheet material in the transport direction. In this way the free-flight path can be reliably covered. The profiling can be effected by the transport belts, but it can also be obtained by elastic rings disposed on the deflection rollers, the circumference of which projecting in radial direction of the deflection rollers over the transport belts. But it becomes immediately obvious, that the checking of a sheet material deformed in a wave-shaped fashion cannot be carried out in a very reliable and regular fashion.

Therefore, it is the problem of the present invention to propose an apparatus for processing sheet material, wherein the sheet material is reliably guided past a checking device in such a way that it is accessible from both sides over its entire width and reliably checkable.

BRIEF SUMMARY

Similar to DE-A 26 55 580 the solution according to the invention provides clamping rings coaxially to the deflection roller, which slightly project over the conveyor belt guided on the deflection roller, so that the sheet material at the moment at which it is introduced between the two components of the checking device, is lifted from the conveyor belt. The sheet material is clamped between the clamping rings and the transport devices located opposite the clamping rings. In contrast to the DE-A 26 55 580 the clamping rings here do not serve for impressing a reversible wave-shaped profile onto the sheet material in order to thereby obtain an increase of the stiffness of the sheet material. The sheet material rather is reliably grasped and guided with the help of the clamping rings. For supporting this process there is a guide plate combing with the clamping rings. In the slot between the guide plate and the component of the checking device disposed opposite the guide plate is located the sheet material in a defined plane position. As to ensure that the sheet material is accessible from two sides, the guide plate is to be adjusted according to the requirements of the respective checking devices and is made of, for example, a material pervious to radiation such as plastic or glass and can be designed in multiple fashions, for example also as a latticed plate. The sheet material is lifted off the conveyor belt with the help of the clamping rings and guided along the guide plate combing with the clamping rings in a plane alignment through between the two components of the checking device. The influence of gravity on the guiding of the sheet material is negligible in the case of transport speeds of 10 m/s, and also at transport speeds of 5 m/s the influence is so weak that difficulties are not to be expected.

The transport devices located opposite the conveyor belt, for example, can be transport rollers spaced apart from each other, the clamping rings co-operating with transport rollers or sensor rollers disposed in transport direction directly before and preferably also behind the checking device. The transport devices, however, can also comprise a further conveyor belt, which is led away from the transport path before the checking device with the help of at least one deflection roller. In this case the clamping rings can either co-operate directly with a surface of the second conveyor belt or with respective clamping rings disposed coaxial to the deflection roller of the second conveyor belt.

Preferably, the conveyor belt or the conveyor belts are led around the checking device with the help of the deflection roller and, optionally, further deflection rollers. This offers substantial functional advantages compared to conveyor belts that before and behind the checking device are reversed by 180° with the help of reversing rollers, since e.g. damaged parts of bank notes cannot jam between roller and returning belts, which otherwise would lead to failures in transport.

Advantageously, the clamping rings at least along their outside circumference are made of elastic material, such as polyurethane or silicone. Such clamping rings can deform during the transport of multiple picks without the lift of the axis of rotation of the clamping ring in such a way that such multiple picks can be transported through between the clamping rings and the opposite transport devices without the occurrence of jams. The circumference path of the clamping rings preferably slightly overlaps with a circumference path of the opposite co-operating transport device, so that always a minimum pressure is provided between the clamping rings and the opposite transport devices for the reliable transport of the sheet material.

For reasons of design it is preferred to dispose the clamping rings and the at least one deflection roller on one common shaft, here the clamping rings in the simplest case can be disposed as elevations on the surface of the deflection roller or as separate clamping rings disposed between the individual belts of the conveyor belt and radially projecting over these. Preferably, however, the clamping rings are rollers passively rotating independent of the deflection rollers, which rotate along with the opposite actively driven transport device. This preferred variant has several advantages. On the one hand with clamping rings rigidly connected to the deflection roller the circumferential speed and thus the transport speed of the clamping rings acting upon the sheet material would be larger than the transport speed of the conveyor belt, since the clamping rings at least slightly radially project over the conveyor belt. This is avoided, when the transport speed is determined by the transport devices located opposite the clamping rings. On the other hand due to the elastic clamping rings no inert masses of the roller support have to be overcome, when the sheet material is fed into the checking device. Merely an elastic deformation of the clamping ring jacket occurs. With that a troublefree transport even of e.g. ten multiple picks is possible.

A further advantageous embodiment provides that the clamping rings are rigidly connected to each other, so that they run absolutely uniform. In this way it can be avoided that the sheet material is inclined when fed into the checking device.

A preferred embodiment of the guide plate provides that it defines a guiding channel for the sheet material to be checked located relative to the component of the checking device disposed opposite the guide plate, the narrowest point of the guiding channel lying in transport direction behind the clamping rings, so that the sheet material can be fed unimpeded before the clamping point and then can be grasped by the elastic clamping rings.

Furthermore, it has proved to be advantageous when the guide plate is slightly inclined, so that the guiding channel continuously widens behind the narrowest point.

DESCRIPTION OF THE DRAWING

In the following the invention is described by way of example with reference to the accompanying figures.

DETAILED DESCRIPTION OF THE EXEMPLARY EMBODIMENTS

Figure 1:
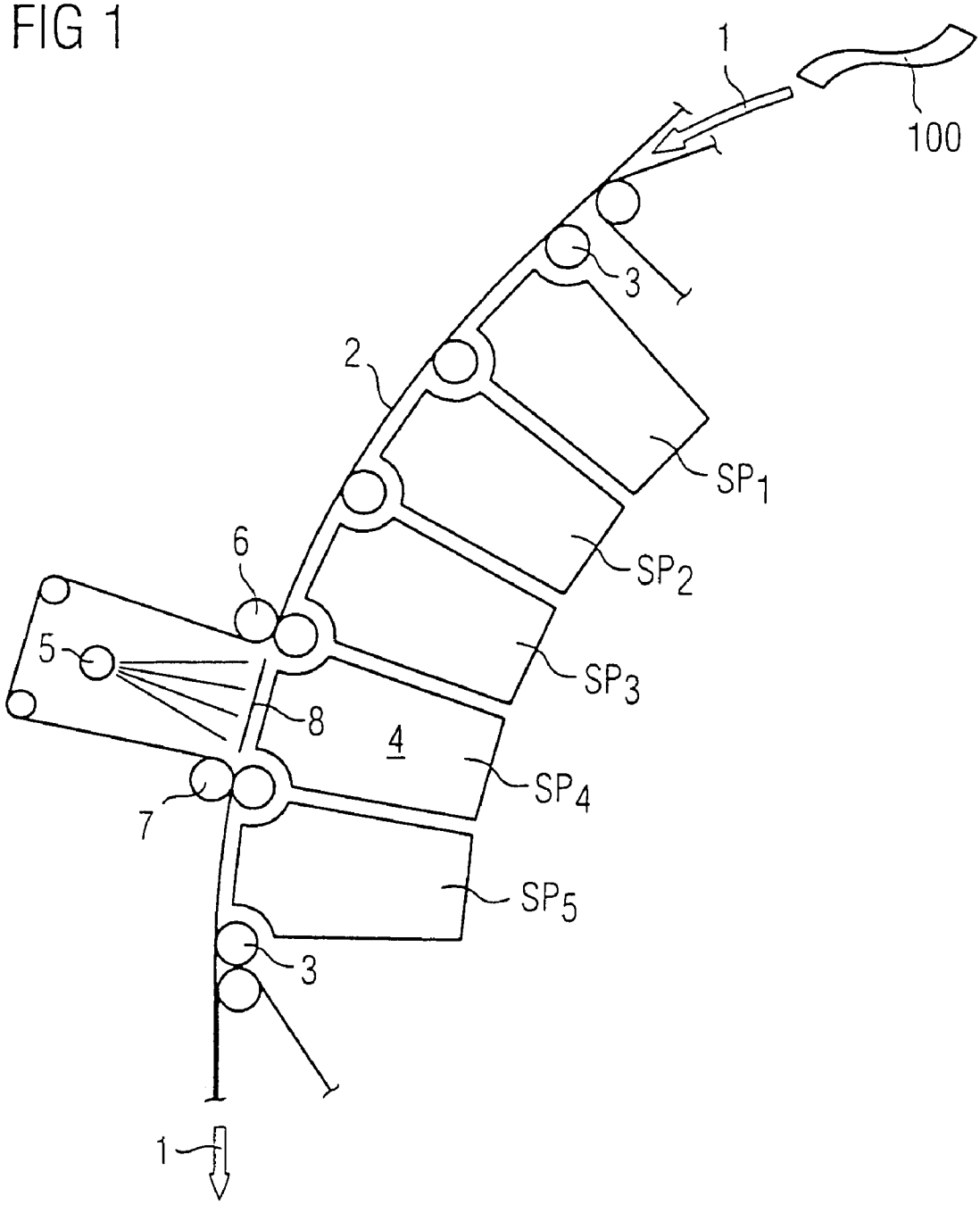
FIG. 1 shows a schematic detail of a bank note processing apparatus having a plurality of sensor places SP 1 to SP 5.

FIG. 1 schematically shows a detail of a bank note processing apparatus with a total of 5 sensor places SP 1 to SP 5. Bank notes 100 are guided along a transport path 1 past the sensor places SP. The transport path 1 on the one side of the transported bank notes is formed by a conveyor belt 2 and on the other side by transport rollers 3 in transport direction spaced apart from each other. The bank notes 100 are held between the conveyor belt 2 and the transport rollers 3 located opposite and are guided past the sensor places SP, which in each case are disposed between two adjacent transport rollers 3. By means of the arc-shaped arrangement of adjacent sensor places SP each disposed at an angle of 3° or more it is achieved that the conveyor belt 2 can exert a pressure force onto the transported bank notes 100 in the direction of the sensor places SP without additional pressing devices. Instead of the transport rollers 3 located opposite the conveyor belt 2 optionally other transport devices can be provided. In particular, the transport rollers 3 can be deflection rollers of a conveyor belt located opposite the conveyor belt 2. If a sensor place SP is not occupied by a sensor, the transport path in the respective area can be realized by a simple guide plate.

In the shown embodiment all of the five sensor places are occupied, the in transport direction first three sensors SP 1 to SP 3 and the last sensor SP 4 being adapted to sense one side of the bank notes guided past them. Also the fourth sensor at the sensor place SP 4 serves for sensing one side of the bank note 100. But in this case it is a transmission sensor 4, which requires an illumination of the bank notes 100 from the opposite bank note side with the help of a radiation source 5, in order to being able to deliver measuring results. As to being able to irradiate the bank notes 100 over the entire transport width with the help of the radiation source 5 and to sense them with the help of the opposite sensor 4, the conveyor belt 2 in the respective section is led away from the transport path 1 with the help of a first deflection roller 6, is led around the radiation source 5 and with the help of a second deflection roller 7 again is led towards the transport path 1. Between the two deflection rollers 6 and 7 the transport path 1 is completed by a guide plate 8. Then the bank notes 100 are transported through a guiding channel formed between the guide plate 8 and the sensor 4 and are irradiated through the guide plate 8 by the radiation source 5.

Figure 2:
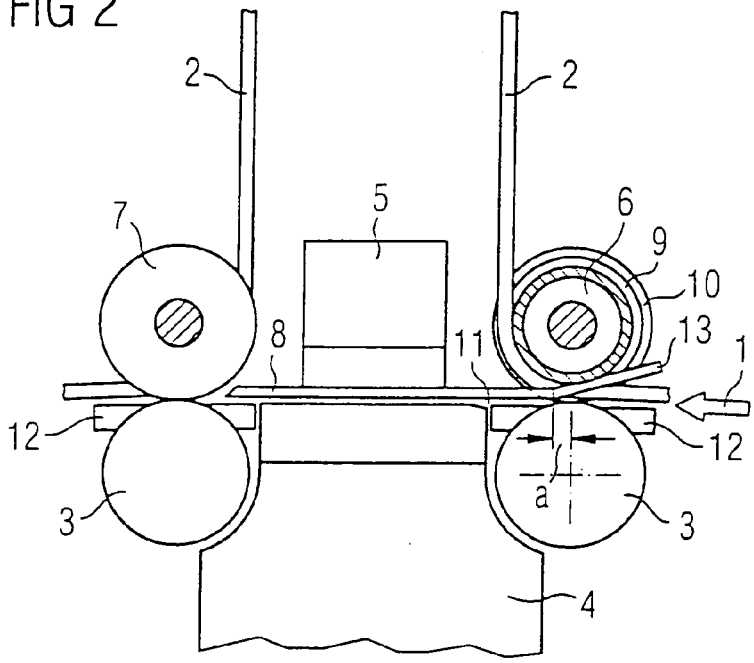
FIG. 2 shows a partial section of FIG. 1 with one single sensor place according to a first embodiment.

FIG. 2 shows a section of FIG. 1 in the area of the sensor place SP 4 in more detail. The conveyor belt 2 consists of a plurality of round belts not represented in detail, running in parallel to each other, which with the help of the first deflection roller 6 are led away from the transport path 1 and with the help of the second deflection roller 7 again are led towards the transport path 1. From the first deflection roller 6 represented as a sectional view one can notice, that the individual round belts of the conveyor belt 2 run in pertinent grooves 9. The depth of the grooves 9 is selected larger than the thickness of the conveyor belt 2. The external circumference of the deflection roller 6 thus radially projects over the conveyor belt 2 and assumes the function of a clamping ring 10. This clamping ring 10 and the transport roller 3 located opposite the clamping ring 10 grasp a bank note fed with the help of the conveyor belt 2, lift the bank note from the conveyor belt 2 and transport it through between the sensor 4 and the radiation source 5. The second deflection roller 7 has the same structure and co-operates with the transport roller 3 located opposite in exactly the same way as the first deflection roller 6.

The clamping ring 10 or at least its surface is formed of an elastic material, such as polyurethane or silicone. The circumferential lines of the clamping ring 10 and the transport roller 3 located opposite slightly overlap each other by for example 0.2 millimeters, so that on the one hand the reliable grasping of an introduced bank note is ensured by producing a minimum pressure on the bank note, and on the other hand multiple picks of for example up to 10 bank notes can be transported between the clamping ring 10 and the transport roller 3 without a lift of the deflection roller 6.

Various guide elements are provided, so as to ensure the plane transport of the bank note past the sensor 4. For this purpose the guide plate 8 together with the sensor head of the opposite sensor 4 and with guide combs 12 disposed in transport direction before and behind the sensor head form a guiding channel 11. The guide plate 8 is adjustable (not displayed) as to being able to adjust the guiding channel to the sheet material to be processed. Usually, however, the slot width is adjusted to an optimal value exclusively before the delivery of the apparatus to the customer. The introduction zone 13 of the guide plate 8 combs with the clamping rings 10 of the deflection roller 6. In a corresponding fashion the guide combs 12 comb with the transport rollers 3. That means, the transport rollers 3 also have parallel circumferential grooves, which are not explicitly displayed in FIG. 2. The end of the introduction zone 13 of the guide plate 8 is bent away from the transport path 1, as to ensure a reliable introduction of the bank notes into the guiding channel 11. The transport slot for the bank notes defined by the guiding channel 11 has a narrowest slot width located at a minor distance a behind the contact point of the clamping ring 10 and the opposite transport roller 3. This distance a preferably amounts to about 4 to 5 millimeters with a narrowest slot width of 1.5 millimeters. The slot width of the guiding channel 11 continuously widens in transport direction beginning at the narrowest point to reach an amount of for example about 2.5 millimeters at the end of the guiding channel. By displacing the guide plate 8 the distance a, the narrowest slot width and the maximum slot width at the end of the guiding channel can be varied. As already mentioned these adjustments usually have to be effected only once before the delivery to the customer.

Figure 3:
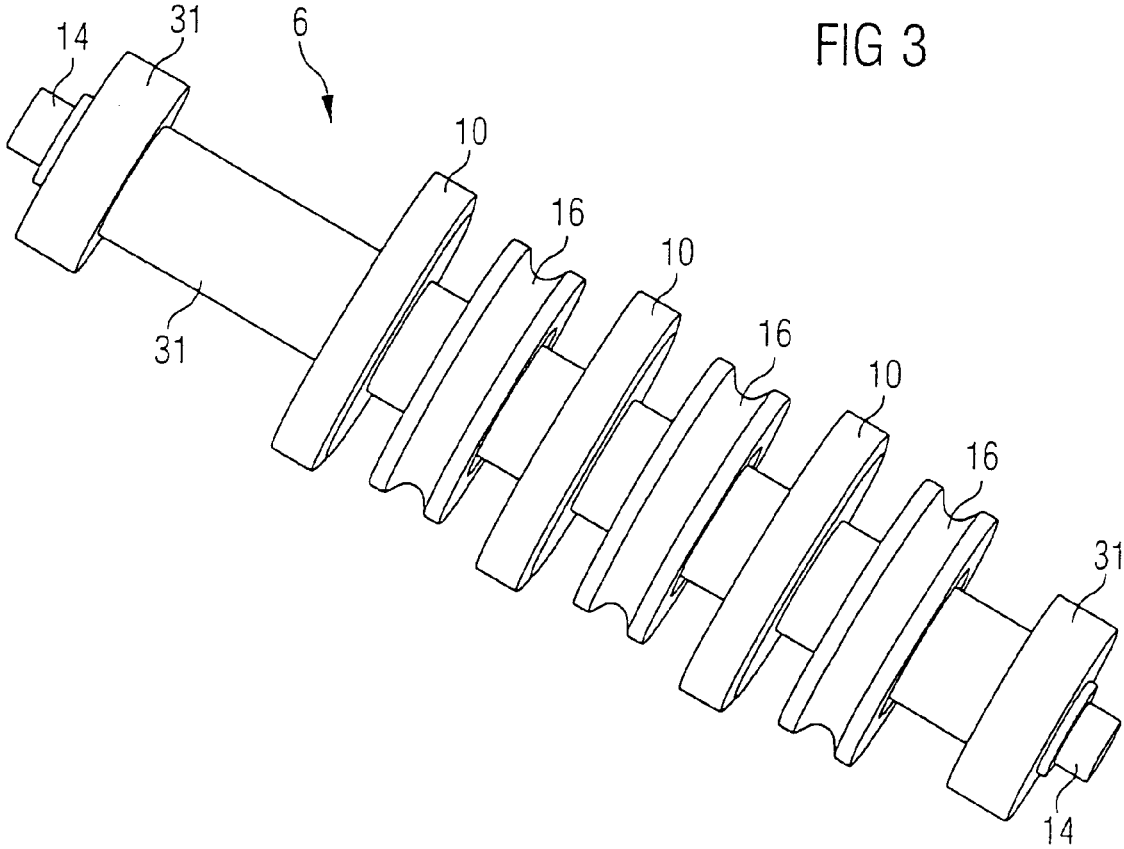
FIG. 3 shows a deflection roller with clamping rings.

FIG. 3 in further detail shows the structural design of the deflection roller 6 with the clamping rings 10. In this specific embodiment the conveyor belt consists of three parallel endless belts, which in each case run on an individually mounted individual roller 16 of the deflection roller 6. Between the individual rollers 16 are provided the clamping rings 10, which are formed as independent clamping rollers. The clamping rollers 10 and the individual rollers 16 are thread onto an inside-located continuous shaft 30 and gripped with screws 14 at the two ends. The rollers 10, 16 are passively operated. I.e., while the individual rollers 16 rotate with the transport speed of the endless belts running on them, the clamping rollers 10 passively rotate via the bearings 31 along with the opposite actively driven transport roller 3. The rotating speed of the individual rollers 16 thus not necessarily is identical with the rotating speed of the clamping rollers 10. Therefore, the clamping rollers 10 run on the shaft 30 mounted with bearing 31 independently of the individual rollers 16. However, the clamping rollers 10 are gripped by the two screws 14, rigidly connected to each other, so as to avoid an off-track running of the bank notes when introduced between the clamping rollers 10 and the transport roller 3 located opposite the clamping rollers 10.

Figure 4:
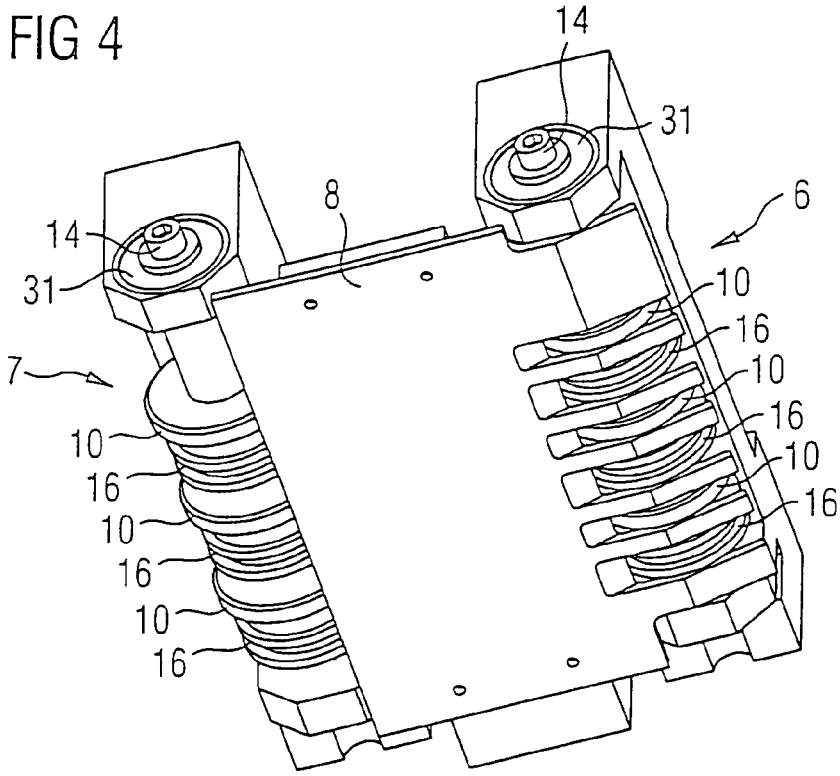
FIG. 4 shows a combination of two deflection rollers with clamping rings and guide plate combing therewith.

FIG. 4 shows, in a perspective view onto the sliding plate, an assembly consisting of the deflection roller 6 and the deflection roller 7 together with the pertinent individual rollers 16 and clamping rings or clamping rollers 10 and the guide plate 8 combing therewith. One can notice that the guide plate 8 does not only comb with the clamping rings or clamping rollers 10 but at the same time also with the individual rollers 16.

Figure 5:
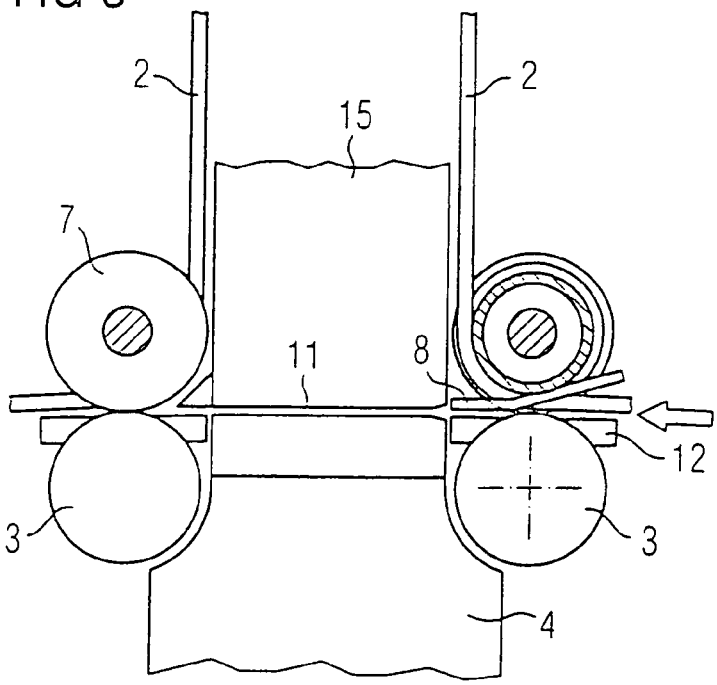
FIG. 5 shows a partial section of FIG. 1 with one individual sensor place according to a second embodiment.

FIG. 5 shows a further embodiment, which differs from the embodiment shown in FIG. 2 mainly in that instead of the radiation source 5 a second sensor 15 is provided, as to sense the two sides of the bank notes transported through the guiding channel 11. Accordingly, the guide plate 8 is formed as to be shorter, since the sensor head of the sensor 15 assumes the guiding function in the guiding channel 11. It has turned out to be advantageous, when the introduction edge of the sensors 4 and 15 is slightly moved backwards in relation to the transport plane of the guide plate 8 or of the guide element 12 by for example 0.5 millimeters and forms a short, flat introduction inclination.

The invention claimed is:

1. An apparatus for processing sheet material such as bank notes, comprising a transport path for the sheet material, a checking device for checking the sheet material with at least two components lying opposite each other along the transport path, a conveyor belt located in transport direction before the checking device and transport devices opposite thereto arranged to hold and guide the sheet material, wherein the conveyor belt with the help of at least one deflection roller is led away from the transport path before the checking device, said sheet material in the sensing region of the checking device being without guidance by a conveyor belt, and clamping rings, which are disposed coaxial to the at least one deflection roller disposed in transport direction before the checking device and project over the conveyor belt, wherein the transport devices lying opposite the conveyor belt co-operate with the clamping rings, in order to grasp sheet material guided in the transport path and to guide it through between the two components of the checking device, and by the co-operation of the transport devices with the clamping rings the sheet material is led through between the two components of the checking device in plane alignment and for supporting this process a guide plate is provided, and includes a zone that combs with the clamping rings.

2. The apparatus according to claim 1, wherein the conveyor belt extends around the checking device via at least one deflection roller.

3. The apparatus according to claim 1, wherein the clamping rings at least along their outside circumference comprise of elastic material.

4. The apparatus according to claim 3, wherein the circumference path of the clamping rings slightly overlaps with a circumference path of the transport devices co-operating with them.

5. The apparatus according to claim 1, wherein the clamping rings and the at least one deflection roller are disposed on a common shaft.

6. An apparatus for processing sheet material such as bank notes, comprising a transport path for the sheet material, a checking device for checking the sheet material with at least two components lying opposite each other along the transport path, a conveyor belt located in transport direction before the checking device and transport devices opposite thereto arranged to hold and guide the sheet material, wherein the conveyor belt with the help of at least one deflection roller is led away from the transport path before the checking device, said sheet material in the sensing region of the checking device being without guidance by a conveyor belt, and clamping rings, which are disposed coaxial to the at least one deflection roller disposed in transport direction before the checking device and project over the conveyor belt, wherein the transport devices lying opposite the conveyor belt co-operate with the clamping rings, in order to grasp sheet material guided in the transport path and to guide it through between the two components of the checking device, and by the co-operation of the transport devices with the clamping rings the sheet material is led through between the two components of the checking device in plane alignment and for supporting this process a guide plate is provided, and includes a zone that combs with the clamping rings;

wherein the transport devices are actively driven and the clamping rings independently of the at least one deflection roller passively rotate along with the transport rollers.

7. The apparatus according to claim 1, wherein the clamping rings are rigidly connected to each other.

8. An apparatus for processing sheet material such as bank notes, comprising a transport path for the sheet material, a checking device for checking the sheet material with at least two components lying opposite each other along the transport path, a conveyor belt located in transport direction before the checking device and transport devices opposite thereto arranged to hold and guide the sheet material, wherein the conveyor belt with the help of at least one deflection roller is led away from the transport path before the checking device, said sheet material in the sensing region of the checking device being without guidance by a conveyor belt, and clamping rings, which are disposed coaxial to the at least one deflection roller disposed in transport direction before the checking device and project over the conveyor belt, wherein the transport devices lying opposite the conveyor belt co-operate with the clamping rings, in order to grasp sheet material guided in the transport path and to guide it through between the two components of the checking device, and by the co-operation of the transport devices with the clamping rings the sheet material is led through between the two components of the checking device in plane alignment and for supporting this process a guide plate is provided, and includes a zone that combs with the clamping rings;

wherein the guide plate extends opposite one of the two components of the checking device along the transport path and defines a guiding channel for the sheet material to be checked, the narrowest point of which lies in transport direction behind the clamping rings.

9. The apparatus according to claim 8, wherein the guiding channel continuously widens in transport direction behind the narrowest point.

10. The apparatus according to claim 1, wherein the transport devices lying opposite the conveyor belt are transport rollers in transport direction spaced apart from each other.

11. The apparatus according to claim 1, wherein the transport devices lying opposite the conveyor belt also comprise a conveyor belt, which is led away from the transport path before the checking device via one deflection roller.

* * * * *